United States Patent [19]

Aoyama

[11] 4,170,972

[45] Oct. 16, 1979

[54] EXHAUST GAS RECIRCULATION CONTROL SYSTEM

[75] Inventor: Syunichi Aoyama, Yokohama, Japan

[73] Assignee: Nissan Motor Company, Limited, Japan

[21] Appl. No.: 817,994

[22] Filed: Jul. 21, 1977

[30] Foreign Application Priority Data

Jul. 23, 1976 [JP] Japan ..... 51/87845

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,926,161 | 12/1975 | Wertheimer | 123/119 A |
| 3,973,535 | 8/1976 | Sugihara et al. | 123/119 A |
| 4,006,721 | 2/1977 | Takagi et al. | 123/119 A |
| 4,013,052 | 3/1977 | Masaki et al. | 123/119 A |
| 4,027,638 | 6/1977 | Moriya et al. | 123/119 A |
| 4,031,871 | 6/1977 | Hamanishi | 123/119 A |
| 4,033,309 | 7/1977 | Hayashi et al. | 123/119 A |
| 4,041,914 | 8/1977 | Sugihara et al. | 123/119 A |
| 4,041,917 | 8/1977 | Suzuki | 123/119 A |
| 4,057,043 | 11/1977 | Harada | 123/119 A |

*Primary Examiner*—Wendell E. Burns

*Attorney, Agent, or Firm*—Robert E. Burns; Emmanuel J. Lobato; Bruce L. Adams

[57] ABSTRACT

An EGR control valve is closably disposed in an EGR passageway connecting an intake passageway and an exhaust gas passageway which leads to an internal combustion engine. The EGR control valve is operated to control recirculated exhaust gas flow by varying the exhaust gas pressure in a chamber between a restriction disposed in the EGR passageway and the EGR valve, in accordance with variations in a venturi vacuum in the intake passageway to prevent the recirculated exhaust gas flow from being affected by the exhaust gas pressure in the EGR passageway upstream of the chamber. Furthermore, the EGR control valve is arranged to be controlled so that the amount of the recirculated exhaust gas flow is reduced during high engine speed and low load engine operation.

12 Claims, 1 Drawing Figure

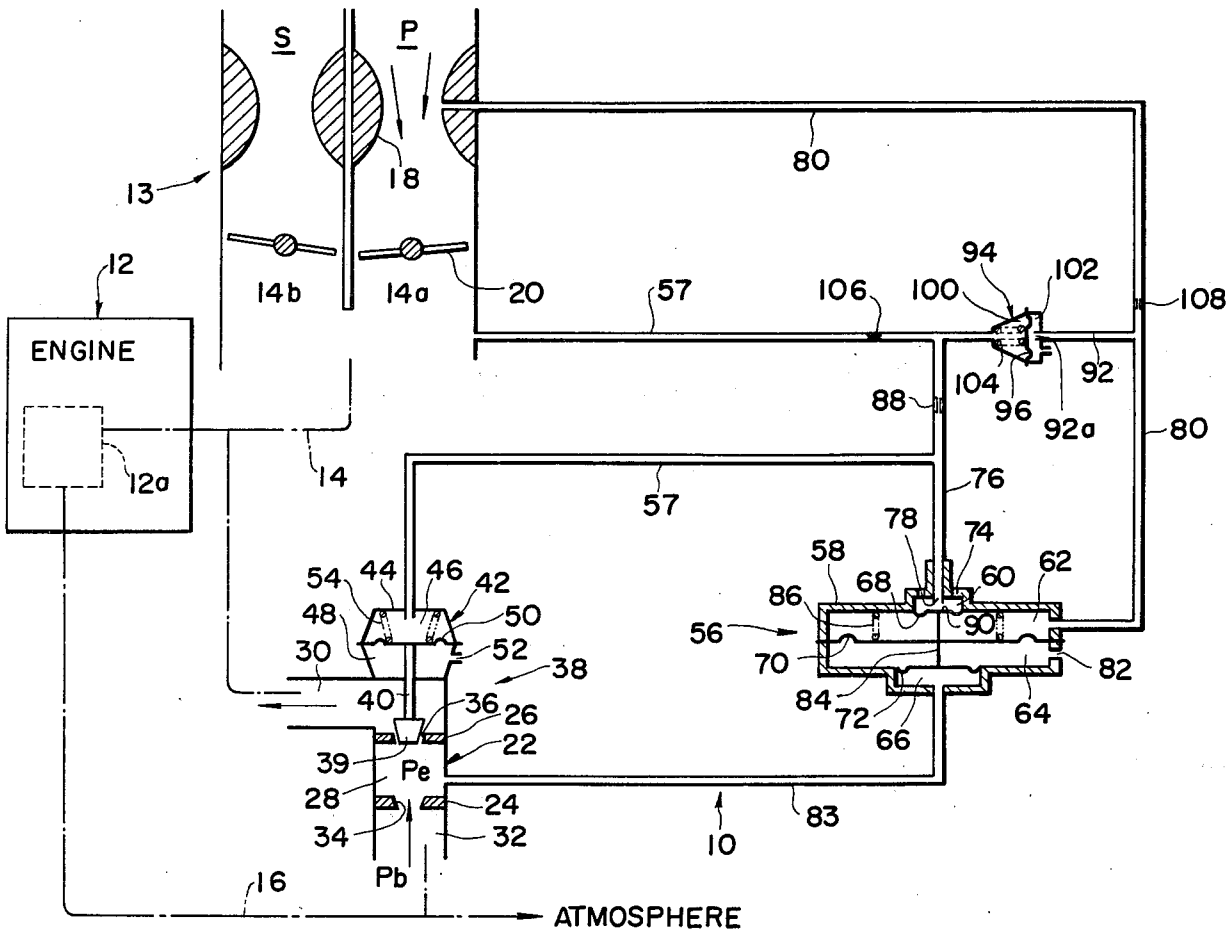
ENGINE
ATMOSPHERE
P
S
Pe
Pb

EXHAUST GAS RECIRCULATION CONTROL SYSTEM

BACKGROUND OF THE INVENTION

This invention relates to an EGR (Exhaust Gas Recirculation) control system for controllably feed a portion of the exhaust gases passing through the exhaust passageway of an internal combustion engine back to the combustion chamber of the same.

It is well known in the art that a part of the exhaust gases of an internal combustion engine is recirculated back to the combustion chamber of the engine in order to suppress the maximum temperature of the combustion taking place in the combustion chamber to reduce the emission level of nitrogen oxides (NOx) which are generated during the combustion in the combustion chamber. By virtue of this exhaust gas recirculation, the NOx emission level has thus effectively been lowered. However, the recirculated exhaust gas considerably affects the combustion in the combustion chamber and the driveability of engine and therefore its amount is desired to be strictly controlled in response to engine operation conditions.

In this regard, the following EGR control system has been proposed by the same applicant as the present application: An EGR control valve is closeably disposed in an EGR passageway connecting an intake passageway and an exhaust passageway of an internal combustion engine. The EGR control valve is operated to control the exhaust gas recirculated back to the combustion chamber of the engine, which is accomplished by varying the exhaust gas pressure in the EGR passageway upstream of the EGR control valve in accordance with the variations of a venturi vacuum in the intake passageway. By this EGR control system, the recirculated exhaust gas flow is prevented from being affected by the variation of exhaust gas pressure in the EGR passageway. As a result, the recirculated exhaust gas flow can be controlled only in accordance with the venturi vacuum which is highly reliable as a function of the flow amount of the intake air conducted through the intake passageway into the combustion chamber. This EGR control system makes it possible to effectively decrease NOx emission level without causing the degradation of the engine driveability.

It has been desired in the above-mentioned EGR control system to effectively lower the rate of the flow amount of the recirculated exhaust gases with respect to the flow amount of the intake air conducted into the combustion chamber of the engine (this rate is referred to as "EGR rate" hereinafter) under high engine speed and low load engine operating condition. Because under such an operating condition, it is eagerly desired to improve fuel consumption or economy and driveability of the engine.

SUMMARY OF THE INVENTION

It is a principal object of the present invention to provide an improved EGR control system for an internal combustion engine, by which the emission level of nitrogen oxides is greatly lowered maintaining high fuel economy and high engine driveability even under high speed and low load engine operating condition.

Another object of the present invention is to provide an improved EGR control system for an internal combustion engine, in which EGR rate is lowered during high speed and low load engine operation as compared with during the other engine operations.

A further object of the present invention is to provide an improved EGR control system for an internal combustion engine, in which the EGR rate is lowered when the sum of the vacuum applied to a diaphragm operatively connected to the EGR control valve and the intake vacuum downstream of a throttle valve exceeds a predetermined level which represents a high speed and low load engine operation.

Other objects, features and advantages of the EGR control system according to the present invention will be more apparent from the following description taken in conjunction with the accompanying drawing.

BRIEF DESCRIPTION OF THE DRAWING

In the drawing, the single FIGURE is a schematic view of a preferred embodiment of an EGR control system according to the present invention.

DESCRIPTION OF THE PREFERRED EMBODIMENT

Referring now to the single FIGURE of the drawing, a preferred embodiment of an exhaust gas recirculation (EGR) control system 10 according to the present invention is shown as combined with an internal combustion engine 12 having a combustion chamber **12*a* or combustion chambers therein. The engine 12 is, as usual, composed of air-fuel mixture preparing means such as a carburetor 13 for preparing an air-fuel mixture to be conducted into the combustion chamber 12*a* or combustion chambers. In this embodiment, the carburetor 13 is of a constant-venturi two-barrel type and accordingly composed of a primary section P operative at a relatively low load engine operating range and a secondary section S operative at a relatively high load engine operating range. The carburetor 13** may be of a single-barrel type.

Connecting between the carburetor 13 and the combustion chamber **12*a* is an intake passageway 14 which passes through the carburetor 13 and consequently is separated in the carburetor into two portions 14*a* and 14*b* which pass through the primary section P and secondary section S, respectively. The reference numeral 16 indicates an exhaust gas passageway providing communication between the combustion chamber 12*a* and the atmosphere to allow the exhaust gases from the combustion chamber 12*a* to flow therethrough. As shown, the intake passageway portion 14*a* has a venturi 18 or a main venturi formed therein and a throttle valve 20 rotatably mounted downstream of the venturi 18**.

The EGR control system 10 is composed of an EGR passageway 22 providing communication between the exhaust gas passageway 16 and the intake passageway 14 downstream of the throttle valve 20 for recirculating or conducting engine exhaust gas into the intake passageway 14. The EGR passageway 22 is formed therein with partition members 24 and 26 which divide the EGR passageway 22 into a chamber 28 defined between the partition members 24 and 26 and upstream and downstream parts 30 and 32 located, respectively, upstream and downstream of the chamber 28. The partition member 24 is formed therethrough with an orifice 34 which provides communication between the upstream part 30 and the chamber 28 and forms together with the partition member 24 a restriction of the EGR passageway 22 which controls the flow of recirculated engine exhaust gas. The partition member 24 may not be used because the EGR passageway 22 itself serves as a restriction for the flow of exhaust gases. The partition member 26 or a valve seat is formed therethrough with an aperture or passage 36 which provides communication between the chamber 28 and the downstream part 30.

An EGR control valve assembly 38 is disposed such that its valve head 39 in the EGR passageway 22 is movable relative to the partition member 26. The valve head 39 is secured to a valve stem 40 extending therefrom externally of the EGR passageway 22. The EGR control valve assembly 38 includes a diaphragm unit 42 for operating the EGR control valve 38. The diaphragm unit 42 is composed of a housing 44 having first and second fluid chambers 46 and 48, and a flexible diaphragm 50 separating the fluid chambers 46 and 48 from each other. The fluid chamber 48 is communicated through a hole 52 with the atmosphere. A spring 54 is provided to normally urge the diaphragm 50 in a direction to cause the valve head 39 to close the aperture 36. In this embodiment, the fluid chamber 46 of the diaphragm unit 42 communicates with the intake passageway 14 downstream of the throttle valve 20 through a passage 57 to receive a suction vacuum in the passageway 14. Alternatively, the fluid chamber 46 may communicate with the intake passageway 14 at a location which is just on the atmospheric or upstream side of the peripheral edge of the throttle valve 20 in its fully closed position and is varied to the suction vacuum or downstream side of the throttle valve 20 opened above a certain amount.

A pressure regulating valve assembly 56 is provided to control the vacuum for operating the EGR control valve 38. The valve assembly 56 comprises a housing 58 having therein four chambers 60, 62, 64 and 66, and three flexible diaphragms 68, 70 and 72. The diaphragm 68 separates the chambers 60 and 62 from each other. The diaphragm 70 separates the chambers 62 and 64 from each other. The diaphragm 72 separates the chambers 64 and 66 from each other. The chamber 60 communicates with the atmosphere through an opening 74 and with the passage 57 through a passage 76 and an inlet port 78. The chamber 62 communicates with the venturi 18 through a passage 80. The chamber 64 communicates through a hole 82, with the atmosphere. The chamber 66 communicates with the chamber 28 of the EGR passageway 22 through a passage 83. The diaphragm 70 has a working or pressure acting surface area larger than that of each of the diaphragms 68 and 72. The diaphragms 68, 70 and 72 are fixedly connected to each other, for example, by means of a rod 84 so that they are operated as one body. A spring 86 is provided to integrally urge the diaphragms 68, 70 and 72 in a direction opposed by the atmospheric pressure in the chamber 70. An orifice 88 is formed in the passage 57 on the intake passageway side of the junction to which the passage 76 is connected. A control valve 90 is located in the chamber 60 movably relative to the port 78 to control the flow of atmospheric air into the port 78 and is fixedly secured to the diaphragm 68.

A relief passage 92 is connected at its one end to the passage 57 on the intake passageway side of the orifice 88, and the other end thereof to the passage 80. Disposed in the relief passage 92 is a relief valve 94 which is composed of a diaphragm or a diaphragm valve member 96. The diaphragm 96 separates the interior of a casing 98 into a vacuum chamber 100 which communicates with the passage 57 and an atmospheric chamber 102 which is communicated with the atmosphere and with the passage 80 through the relief passage 92. A spring 104 is disposed in the vacuum chamber 100 to normally urge the diaphragm 96 in the direction to contact to and close the open end **92*a* of the relief passage 92 or an open end portion connecting to the relief passage 92. The end portion 92*a* is secured to a portion of the casing 98. This relief valve 94 is constructed and arranged to open the open end 92*a* of the passage 92 to bleed the atmospheric air through the passage 92 into the passage 80 when the vacuum applied to the diaphragm 96 exceeds a predetermined level. As seen, an orifices 106 is disposed in the passage 57 on the intake passageway side of the junction to which the passage 92 is connected. Additionally, an orifice 108 is disposed in the passage 80 on the carburetor venturi side of the junction to which the relief passage 92** is connected.

The operation of the thus arranged EGR control system 60 will be discussed hereinafter.

When the venturi vacuum is increased, the diaphragms 68, 70 and 72 are integrally moved so that the valve 98 reduces the degree of opening of the port 78 to reduce the flow of atmospheric air admitted into the passage 76 and therefore the degree of dilution of the suction vacuum conducted into the chamber 46 is reduced. As a result, the degree of opening of the EGR control valve 38 is increased to increase the amount of exhaust gases recirculated into the combustion chamber **12*a* of the engine. This reduces the pressure $P_e$ in the chamber 28 and therefore in the chamber 66 of the valve assembly 56. The decrease in the pressure $P_e$ moves the diaphragms 68, 70 and 72 integrally to increase the degree of opening of the control valve 90 to the port 78 to increase the flow of atmospheric air admitted into the passage 76. As a result, the dilution of the suction vacuum by the atmospheric air is increased to reduce the degree of opening of the EGR control valve 38 to increase the pressure $P_e$ in the chamber 28**.

On the contrary, when the venturi vacuum is decreased, the degree of dilution of the suction vacuum conducted into the chamber 46 is increased and accordingly the degree of opening of the EGR control valve 38 is decreased to decrease the amount of exhaust gases recirculated into the combustion chamber **12*a* of the engine. This increases the pressure $P_e$ and accordingly the pressure in the chamber 66 of the valve assembly 56. As a result, the dilution of the suction vacuum by the atmospheric air is decreased to increase the degree of the opening of the EGR control valve 38 to reduce the pressure $P_e$ in the chamber 28**.

By the repetition of such operations or such feedback controls, the pressure $P_e$ and the degree of opening of the EGR control valve 38 are converged respectively to values in which the pressure $P_e$ is balanced with the venturi vacuum to increase and reduce the recirculated exhaust gas flow accurately in accordance with the increases and decreases in the venturi vacuum.

When the pressure $P_e$ in the chamber 28 is varied regardless of the venturi vacuum by variations in the suction vacuum, the EGR control valve 38 is operated to cancel the variations in the pressure $P_e$ by the pressure regulating valve assembly 56. In this instance, when the pressure $P_e$ is a negative pressure and the negative pressure is increased, the diaphragms 68, 70 and 74 are integrally moved to increase the degree of opening of the control valve 90 to the port 78. As a result, the degree of opening of the EGR control valve 38 is reduced similarly as mentioned above to reduce the influence of the suction vacuum on the pressure $P_e$ to restore same to an initial value to prevent the recirculated exhaust gas flow from being varied irrespective of the venturi vacuum.

It will be appreciated from the foregoing that the pressure $P_e$ is controlled to a predetermined level and therefore the recirculated exhaust gas flow is varied only as a function of the venturi vacuum generated at the venturi portion of the carburetor.

Under high speed and low load engine operating condition where the NOx emission level is relatively low, both the venturi vacuum generated at the venturi 18 of the carburetor 13 and the intake vacuum downstream of the throttle valve 20 increase. Consequently, the composed vacuum or the sum of the intake vacuum downstream of the throttle valve 20 and the suction vacuum applied to the chamber 46 of the diaphragm unit 42 is increased over a predetermined level and applied to the diaphragm 96 of the relief valve 94 to move it in the direction to separate from the open end 92*a* of the passage 92 against the bias of the spring 104. The atmospheric air then bleeds into the passage 80 leading to the chamber 62 of the valve assembly 56 and consequently the venturi vacuum conducted into the chamber 62 is weakened to increase the opening degree of the control valve 90 to the port 78. As a result, the suction vacuum conducted into the chamber 46 of the diaphragm 42 is weakened to a level and accordingly the composed vacuum applied to the diaphragm 96 of the relief valve 94 is decreased. The diaphragm 96 is thus moved toward the open end 92*a* of the passage 92 to decrease the opening degree of the diaphragm 96 to the open end 92*a* of the passage 92. By this action of the relief valve, the venturi vacuum in the chamber 62 of the valve assembly 56 is increased, but it again increases the suction vacuum in the passage 76 to increase the opening degree of the diaphragm 96 to the open end 92*a*. Therefore, the diaphragm 96 of the relief valve 94 is balanced to maintain a suitable bleed amount of air into the passage 80 and the chamber 62 of the valve assembly 56.

Thus, the increase of the recirculated gas flow is suppressed under high and low load engine operation condition, and the EGR rate is decreased with increased amount of intake air passing through the intake passageway 14 after the air bleed through the relief valve 94 begins.

In this EGR control system, even if the venturi vacuum generated at the venturi 18 of the intake passage 14 is not so high, the air bleed through the relief valve 94 is allowed to be begun when the intake vacuum or intake manifold vacuum downstream of the throttle valve 20 is relatively high, i.e., during low load engine operation. Accordingly, it is possible to suppress the amount of recirculated exhaust gas flow even at the low load engine operation condition which is encountered frequently during normal engine operation. It will be appreciated from the foregoing that, during high engine speed and low load engine operation, the composed vacuum of the intake manifold vacuum and the venturi vacuum is increased and therefore the EGR rate can be securely lowered.

After the air bleed through the relief valve 94 is begun, the degree of the vacuum in the chamber 62 of the valve assembly 56 is gradually or slowly decreased with increased degree of the intake vacuum in the intake passage 14*a* downstream of the throttle valve 20. Consequently, the EGR rate is smoothly lowered and therefore the stable engine operation can be maintained even during the lowering process of the EGR rate. It will be understood that rise of the EGR rate is also accomplished smoothly since the vacuum in the chamber 62 of the valve assembly 56 is gradually or slowly increased with the decreased intake vacuum in the intake passage 14 after the amount of air bleed through the relief valve 94 reaches its maximum value. In any event, the stable engine operation is not prevented even during the changing process of the EGR rate.

While only constant-venturi type carburetor has been shown and described as the air-fuel mixture preparing means, it will be understood that a variable-venturi or constant-vacuum carburetor, or an fuel injection system may be used as the air-fuel mixture preparing means. In case of the variable-venturi carburetor, the passage 80 for conducting the venturi vacuum may be connected to the venturi portion formed in an intake passageway upstream of a throttle valve, while the passage 57 for induction intake manifold vacuum may be connected to the intake passageway downstream of the throttle valve. In case of the fuel injection system, the passage 80 may be connected to a venturi portion formed in an intake passageway upstream of a throttle valve for controlling the intake air amount, while the passage 57 may be connected to the intake passageway downstream of the throttle valve.

As is apparent from the foregoing, according to the present invention, fuel consumption (the fuel amount consumed for producing a unit output power) and driveability of the engine can be effectively improved, greatly suppressing the formation of nitrogen oxides in the combustion chambers of the engine, since the EGR rate is scheduled to be securely and gradually decreased during high speed and low load engine operation.

What is claimed is:

1. An exhaust gas recirculation (EGR) control system in combination with an internal combustion engine including means defining an intake passageway providing communication between the atmosphere and the combustion chamber of the engine, means defining a venturi formed in the intake passageway, a throttle valve rotatably disposed in the intake passageway downstream of the venturi, and means defining an exhaust gas passageway providing communication between the combustion chamber of the engine and the atmosphere, said EGR control system comprising:

means defining an EGR passageway providing communication between the exhaust gas passageway and the intake passageway for recirculating thereinto exhaust gas emitted from the engine;

an EGR control valve disposed in said EGR passageway to separate said EGR passageway into two parts, said EGR control valve being operable in opposite directions to increase and reduce the pressure of engine exhaust gas in the part of said EGR passageway upstream of said EGR control valve for controlling the flow of recirculated engine exhaust gas;

means for operating said EGR control valve in opposite directions to increase and reduce the exhaust gas pressure in the part of said EGR passageway upstream of said EGR control valve in accordance with a decrease and an increase in said exhaust gas pressure and in accordance with a decrease and an increase in a venturi vacuum in said venturi, respectively; and means for decreasing the degree of said venturi vacuum applied to said operating means during high speed and low load engine operation.

2. An EGR control system as claimed in claim 1, in which the means for operating said EGR control valve comprises:

means defining a first passage a first flexible diaphragm defining a first chamber communicating with said intake passageway through said first passage connecting said first chamber and said intake passageway downstream of the throttle valve to receive therein an intake vacuum, means connecting said flexible diaphragm operatively to the valve head of said EGR control valve so that the valve head of said EGR control valve is operated in opposite directions to increase and decrease said exhaust gas pressure in response to a decrease and an increase in said vacuum in said second chamber, respectively;

means defining a second passage connecting to said first passage and having an inlet port communicating with the atmosphere for admitting into said second passage atmospheric air for diluting said vacuum in said first chamber;

a pressure regulating valve located movable relative to said inlet port of said second passage for controlling the flow of atmospheric air admitted into said inlet port; and operating means operatively connected to said pressure regulating valve so that said pressure regulating valve reduces and increases the flow of atmospheric air into said inlet port in response to an increase and a decrease in said venturi vacuum and in response to an increase and a decrease in said exhaust gas pressure for reducing and increasing the dilution of said vacuum in said second chamber by atmospheric air for causing said diaphragm to operate said EGR control valve in opposite directions to reduce and increase said exhaust gas pressure, respectively.

3. An EGR control system as claimed in claim 2, in which said operating means comprises:

means defining a third passage, a second flexible diaphragm defining a second chamber communicating with said venturi through said third passage to receive said venturi vacuum therefrom and a third chamber; and a third flexible diaphragm defining said third chamber and a fourth chamber communicating with the part of EGR passageway upstream of said EGR control valve to receive said exhaust gas pressure therefrom, said third flexible diaphragm being fixedly connected to said second diaphragm, said second and third diaphragms being operatively connected to said pressure regulating valve so that said pressure regulating valve is operated to reduce and increase the flow of atmospheric air into said inlet port in response to an increase and a decrease in said venturi vacuum in said second chamber and in response to an increase and a decrease in said exhaust gas pressure in said fourth chamber, respectively.

4. An EGR control system as claimed in claim 3, in which said means for decreasing the venturi vacuum degree comprises a relief valve means for bleeding air into the second chamber of said operating means when the composed vacuum of the intake vacuum in said intake passageway and the vacuum in said first chamber exceeds a predetermined level representing a high speed and low load engine operation.

5. An EGR control system as claimed in claim 4, in which said relief valve means includes:

means defining a fourth passage connecting said third passage and said first passage on the intake passageway side of the junction to which said second passage is connected;

a relief valve disposed in said fourth passage and having a diaphragm valve member separating the interior of the casing thereof into a vacuum chamber communicating with the first passage and an atmospheric chamber communicating with the third passage and with the atmosphere, an open end portion connecting to the fourth passage on the third passage side, said open end portion being secured to a portion of the casing defining the atmospheric chamber, and a spring disposed in said vacuum chamber to normally urge said diaphragm valve member to contact to said open end portion so as to close said open end portion, said spring being arranged to be contracted to separate said diaphragm valve member from said open end portion when the degree of the vacuum applied to said vacuum chamber exceeds said predetermined level.

6. An EGR control system as claimed in claim 5, further comprising a flow restriction for the exhaust gases passing through said EGR passageway, said flow restriction being disposed in the part of the EGR passageway upstream of said EGR control valve to define a fifth chamber between it and said EGR control valve, means defining a fifth passage, said fifth chamber being communicating through said fifth passage with the fourth chamber of said operating means, said flow restriction including a partition member having therethrough an orifice.

7. An exhaust gas recirculation (EGR) control system in combination with an internal combustion engine having a combustion chamber and an exhaust gas passageway providing communication between the combustion chamber and the atmosphere, said EGR control system comprising:

air-fuel mixture preparing means for producing an air-fuel mixture in the combustion chamber by mixing fuel and intake air conducted into the combustion chamber, said air-fuel mixture preparing means having a throttle valve for controlling the amount of intake air;

means defining an intake passageway providing communication between the combustion chamber and the atmosphere through said air-fuel mixture preparing means forming a part of said intake passageway in said air-fuel mixture preparing means, said intake passageway being formed, at said part of said intake passageway, with a venturi upstream of said throttle valve;

an EGR passageway providing communication between the exhaust gas passageway and the intake passageway for recirculating thereinto exhaust gas emitted from the engine;

an EGR control valve disposed in said EGR passageway to separate said EGR passageway into two parts, said EGR control valve being operable in opposite directions to increase and reduce the pressure of engine exhaust gas in the part of said EGR passageway upstream of said EGR control valve for controlling the flow of recirculated engine exhaust gas;

means defining a first passage, a first flexible diaphragm defining a first chamber communicating with said intake passageway through said first passage connecting said first chamber and said intake passageway downstream of the throttle valve to receive therein an intake vacuum, said EGR control valve having a valve head, said flexible diaphragm being operatively connected to the valve head of said EGR control valve so that the valve head of said EGR control valve is operated in opposite directions to increase and decrease said exhaust gas pressure in response to a decrease and an increase in said vacuum in said second chamber, respectively;

means defining a second passage connecting to said first passage and having an inlet port communicating with the atmosphere for admitting into said second passage atmospheric air for diluting said vacuum in said first chamber;

a pressure regulating valve located movably relative to said inlet port of said second passage for controlling the flow of atmospheric air admitted into said inlet port;

means defining a third passage, a second flexible diaphragm defining a second chamber communicating with said venturi through said third passage to receive said venturi vacuum therefrom and a third chamber;

a third flexible diaphragm defining said third chamber communicating with a part of EGR passageway upstream of said EGR control valve to receive said exhaust gas pressure therefrom, said third flexible diaphragm being fixedly connected to said second diaphragm, said second and third diaphragms being operatively connected to said pressure regulating valve so that said pressure regulating valve is operated to reduce and increase the flow of atmospheric air into said inlet port in response to an increase and a decrease in said venturi vacuum in said second chamber and in response to an increase and a decrease in said exhaust gas pressure in said fourth chamber, respectively; and a relief valve means for bleeding air into the second chamber of said operating means when the composed vacuum of the intake vacuum in said intake passageway and the vacuum in said first chamber exceeds a predetermined level representing a high speed and low load engine operation.

8. An EGR control system as claimed in claim 7, in which said air-fuel mixture preparing means includes a constant-venturi two-barrel type carburetor composed of a primary section operative at a relatively low load engine operating range and a secondary section operative at a relatively high load engine operating range, said throttle valve being disposed in the primary section, said venturi portion being formed in a part of the intake passageway formed in the primary section.

9. An EGR control system as claimed in claim 7, in which said air-fuel mixture preparing means includes a variable-venturi type carburetor.

10. An EGR control system as claimed in claim 7, in which said air-fuel mixture preparing means includes a fuel injection system.

11. An EGR control system as claimed in claim 7, in which said relief valve means includes:

means defining a fourth passage connecting said third passage and said first passage on the intake passageway side of the junction to which said second passage is connected;

a relief valve disposed in said fourth passage and having a diaphragm valve member separating the interior of the casing thereof into a vacuum chamber communicating with the first passage and an atmospheric chamber communicating with the third passage and with the atmosphere, an open end portion connecting to the fourth passage on the third passage side, said open end portion being secured to a portion of the casing defining the atmospheric chamber, and a spring disposed in said vacuum chamber to normally urge said diaphragm valve member to contact to said open end portion so as to close said open end portion, said spring being arranged to be contracted to separate said diaphragm valve member from said open end portion when the degree of the vacuum applied to said vacuum chamber exceeds said predetermined level.

12. An EGR control system as claimed in claim 11, further comprising means defining a flow restriction for the exhaust gases passing through said EGR passageway, said flow restriction being disposed in the part of the EGR passageway upstream of said EGR control valve to define a fifth chamber between it and said EGR control valve, means defining a fifth passage, said fifth chamber communicating through said fifth passage with the fourth chamber of said operating means, said flow restriction including a partition member having therethrough an orifice.

* * * * *